US008921719B2

(12) United States Patent
Suzuki

(10) Patent No.: US 8,921,719 B2
(45) Date of Patent: Dec. 30, 2014

(54) MULTI-DIRECTIONAL SWITCH DEVICE

(71) Applicant: Alps Electric Co., Ltd., Tokyo (JP)

(72) Inventor: Hiroki Suzuki, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 209 days.

(21) Appl. No.: 13/667,789

(22) Filed: Nov. 2, 2012

(65) Prior Publication Data

US 2013/0112532 A1 May 9, 2013

(30) Foreign Application Priority Data

Nov. 4, 2011 (JP) ..... 2011-242499

(51) Int. Cl.
*H01H 9/30* (2006.01)
*H01H 25/04* (2006.01)
*G05G 9/047* (2006.01)

(52) U.S. Cl.
CPC ..... *H01H 25/04* (2013.01); *G05G 9/047* (2013.01); *H01H 2025/043* (2013.01); *H01H 2300/012* (2013.01)
USPC ..... 200/4

(58) Field of Classification Search
CPC ..... H01H 25/041; H01H 2025/043
See application file for complete search history.

(56) References Cited

FOREIGN PATENT DOCUMENTS

JP 2001-291456 10/2001

*Primary Examiner* — Renee S Luebke
*Assistant Examiner* — Ahmed Saeed
(74) *Attorney, Agent, or Firm* — Brinks Gilson & Lione

(57) ABSTRACT

A multi-directional switch device includes: an operation shaft to which an operation knob is mounted to perform a rotating operation and a tilting operation; and a housing, which supports the operation shaft. In the housing, a circuit board which has a second fixed contact on the lower surface, a wafer which has a first fixed contact, a rotation holder which rotates integrally with the operation shaft while allowing oscillation of the operation shaft, a rotation slider which rotates integrally with the operation shaft and slides during the tilting operation, a first movable contact, and a second movable contact are arranged. When the operation shaft is rotated and thus the rotation holder is rotated from a rotation neutral position by about 180 degrees, a first signal is output. When the operation shaft is tilted while the rotation holder is rotated by about ±45 degrees, a second or third signal is output.

7 Claims, 9 Drawing Sheets

MULTI-DIRECTIONAL SWITCH DEVICE

CLAIM OF PRIORITY

This application claims benefit of Japanese Patent Application No. 2011-242499 filed on Nov. 4, 2011, which is hereby incorporated by reference in its entirety.

BACKGROUND

1. Field of the Disclosure

The present disclosure relates to a multi-directional switch device capable of operating an operation shaft formed integrally with an operation knob in multiple directions, and more particularly, to a multi-directional switch device which is appropriate as an input operation unit of a power mirror device mounted in a vehicle.

2. Description of the Related Art

In many vehicles in recent years, a power mirror device which electrically performs folding-in and folding-out operations of side mirrors attached on the left and right of a vehicle body, a visual angle adjustment operation, and the like is generally mounted. Typically, the input operation unit of such a type of power mirror device includes a switch mechanism for selecting any of the left and right side mirrors, a switch mechanism for adjusting the visual angle by tilting the mirror surface of the selected side mirror, and a switch mechanism for simultaneously switching the left and right side mirrors between the folded-in state and the folded-out state.

However, in a case where a switch device used as the input operation unit of the power mirror device is configured so that the three types of switch mechanisms described above are individually operated by different operation knobs, the entirety of the switch device is increased in size, and thus the space factor thereof is degraded. Moreover, when a continuous operation is performed, a finger should be moved to a different operation knob, and thus operability is degraded. Therefore, there is a device in which two types of switch mechanism from among the three types of switch mechanism are made to use an operation knob in common and the three types of switch mechanisms are selectively operated by a total of two operation knobs. However, in consideration of usability, it is convenient to selectively operate the three types of switch mechanisms using a single operation knob, and this easily enhances the space factor of the entirety of the switch device. However, in a case where a single operation knob is used in common for the three types of switch mechanisms, an operation method of each of the switch mechanisms is not clearly distinguished, and thus an operation error easily occurs.

Hitherto, a multi-directional switch device which is configured so that a pressing operation, a rotating operation, and a tilting operation are selectively performed on an operation shaft to which an operation knob is attached, folding-in and folding-out operations of side mirrors are achieved by the pressing operation, selection of the left and right side mirrors is achieved by the rotating operation, and visual angle adjustment of the side mirrors is achieved by the tilting operation is proposed (for example, refer to JP-A-2001-291456).

In the multi-directional switch device according to the related art, when the operation shaft is pressed in the axial direction, a first slider is integrally pressed down, and thus a movable contact held in the first slider comes into contact with a fixed contact provided in a wafer on a side, thereby outputting a command signal for allowing the folding-in or folding-out operation of the left and right side mirrors. In addition, when the operation shaft is rotated when the side mirrors are in the folded-out state, a rotation member integrally rotates, and thus a movable contact held in the rotation member comes into contact with a fixed contact provided on one surface of a circuit board, thereby outputting a mirror selection signal for selecting any of the left and right side mirrors according to the rotation operation direction of the operation shaft. In addition, when the operation shaft is tilted when the side mirror is selected, a second slider driven by the operation shaft linearly slides along the circuit board, and thus a movable contact held in the second slider comes into contact with a fixed contact provided on the other surface of the circuit board, thereby outputting a visual angle adjustment signal for tilting the mirror surface of the selected side mirror in a tilt direction of the operation shaft.

However, in the multi-directional switch device disclosed in JP-A-2001-291456, not only three members (the first slider, the rotation member, and the second slider) that are individually linked with three types of operations (the pressing operation, the rotating operation, and the tilting operation) performed on the operation shaft but also a wafer in addition to a circuit board are needed. Moreover, a cam mechanism, which uses an engagement pin and a return spring is needed to lock the operation shaft during the pressing operation or automatically return the operation knob, resulting in an increase in the number of components. Therefore, there is a problem in that it is difficult to achieve a reduction in cost. In addition, depth dimensions (height dimensions) have to be secured so that the operation shaft is able to be pressed in the axial direction, and a space for assembling the wafer and the like to the side of the first slider has to be secured. Therefore, there is a problem in that it is difficult to achieve a reduction in the size of the entirety of the switch device.

SUMMARY

A multi-directional switch device includes: an operation shaft configured to perform a rotating operation and a tilting operation and that has an operation knob at one end portion; and a housing which supports the operation shaft so as to be rotatable and tiltable, wherein, in the housing, a circuit board which has a through-hole through which the operation shaft penetrates, a first fixed contact and a second fixed contact formed integrally with the circuit board, a rotation holder through which the operation shaft is inserted in a loosely-fitted state in which oscillation of the operation shaft is allowed and which rotates integrally with the operation shaft, a rotation slider through which the operation shaft is inserted to rotate integrally and which slides in a linear form along the circuit board by being driven by the tilted operation shaft, a first movable contact which is held in the rotation holder and is able to come into contact with and be separated from the first fixed contact, and a second movable contact which is held in the rotation slider and is able to come into contact with and be separated from the second fixed contact are provided, among the components, a rotation switch mechanism which includes the rotation holder, the first movable contact, and the first fixed contact is arranged on one surface side of the circuit board, and a slide switch mechanism which includes the rotation slider, the second movable contact, and the second fixed contact is arranged on the other surface side of the circuit board, and the rotation switch mechanism is able to output a signal corresponding to at least one rotation position of the rotation holder, and when the rotation holder is set to a predetermined rotation position, the slide switch mechanism is able to output a signal corresponding to a tilt direction of the operation shaft.

In the multi-directional switch device configured as described above, not only a specific signal is able to be output from the rotation switch mechanism by rotating the operation shaft, but also the signal corresponding to the rotating operation position and the tilting operation direction is able to be output from the slide switch mechanism by rotating the operation shaft to set the rotation holder to a predetermined rotation position and then tilting the operation shaft. That is, since the latter signal is a signal corresponding to not only the tilting operation direction of the operation shaft but also the rotating operation position, different signals are output when the operation shaft, for example, at two different rotating operation positions is tilted in the same direction. Therefore, in the multi-directional switch device, various switch functions needed for the input operation unit and the like of the power mirror device are able to be realized by the rotation switch mechanism arranged on the one surface side of the circuit board and the slide switch mechanism arranged on the other surface side. In addition, since the multi-directional switch device is able to selectively perform the rotating operation and the tilting operation using the single operation knob, usability is good. In addition, since a pressing operation is unnecessary, depth dimensions (height dimensions) and the number of components are easily suppressed.

In the configuration, when the rotation switch mechanism outputs a first signal when the rotation holder is set to a first rotation position that is farthest from a rotation neutral position, the slide switch mechanism outputs a second signal corresponding to the tilt direction of the operation shaft as the operation shaft is tilted when the rotation holder is set to a second rotation position that is separated from the rotation neutral position in one direction part way to the first rotation position, and the slide switch mechanism outputs a third signal corresponding to the tilt direction of the operation shaft as the operation shaft is tilted when the rotation holder is set to a third rotation position that is separated from the rotation neutral position in the other direction part way to the first rotation position, the rotation neutral position and the first rotation position have a point symmetry positional relationship, the second rotation position and the third rotation position have a line symmetry positional relationship, and moreover, the first, second, and third rotation positions are able to be clearly distinguished from each other. Therefore, an operation error is easily prevented.

In this case, when the rotation holder is arranged in an accommodation space on the one surface side of the circuit board in the housing, the operation shaft is tilted using a point that abuts on the rotation holder as an oscillation spot, and the other end portion of the operation shaft is arranged in an accommodation space on the other surface side of the circuit board in the housing, the tilt angle of the operation shaft needed for the tilting operation and the sliding movement amount of the rotation slider are easily set to desired values, and the support structure of the rotation holder and the rotation slider is easily simplified, which is preferable.

In the configuration, when any one of the rotation holder and the housing is provided with a cam surface which extends along a rotational direction of the rotation holder and has trough portions at a plurality of points, and the other thereof holds an engagement member which comes into elastic contact with the cam surface and is able to be engaged with and disengaged from the trough portions, and the cam surface has the trough portions of which the number is at least four so as to position the rotation holder at the rotation neutral position and the first to third rotation positions, respectively, the rotation holder is positioned by causing the engagement member to enter the trough portion of the cam surface during the rotating operation of the operation shaft, and a clicking sensation that occurs during the positioning is able to be perceived by a finger of a user. Therefore, an operation of setting the rotation holder to a desired rotation position is easily and reliably performed.

In the configuration, when a guide groove which is formed by causing an annular groove portion that extends in an annular form and a linear groove portion that extends outward at predetermined intervals to be continuous is provided on an inner wall surface of the housing, a plurality of sliding pins protrude from the rotation slider so as to cause positions of the sliding pins to be restricted by the guide groove, and the sliding pins move along the annular groove portion during rotation of the rotation slider, and the sliding pins move along the linear groove portion during sliding of the rotation slider, the tilting operation of the operation shaft is able to be impeded by the rotation slider when the sliding pin deviates from the linear groove portion and the position thereof is restricted by the annular groove portion, the rotating operation of the operation shaft is able to be impeded by the rotation slider when the sliding pin deviates from the annular groove portion and the position thereof is restricted by the linear groove portion. Therefore, an operation error is less likely to occur and operability is further enhanced.

In the configuration, when an actuator which is biased outward in an axial direction by a spring member is held by the other end portion (an end portion in which the operation knob is not provided) of the operation shaft, a concave receiving surface which supports the operation shaft via the actuator is formed in an inner bottom portion of the housing, and the actuator which comes into elastic contact with the concave receiving surface slides on the concave receiving surface as the operation shaft is tilted, the posture of the operation shaft is easily stabilized, and the rotating operation and the tilting operation are more likely to be smoothly performed, which is preferable.

In the configuration, when the first signal is a signal for folding in and folding out side mirrors that are attached to the left and right of a vehicle body, the second signal is a signal for adjusting a visual angle by tilting a mirror surface of the side mirror on either the left or right, and the third signal is a signal for adjusting a visual angle by tilting a mirror surface of the side mirror on the other of the left and right, a multi-directional switch device which has good operability for the power mirror device and easily achieves a reduction in cost and size is obtained.

In this case, when a wafer which has higher heat resistance than the circuit board is placed in a region of one surface of the circuit board that surrounds the through-hole and the first fixed contact is provided in the wafer, even though relatively high current flows through the first fixed contact during the generation of the first signal and causes heat generation, there is no concern of the wafer and the vicinity thereof being thermally damaged, and thus the reliability of the multi-directional switch device is enhanced, resulting in an increase in the long-term life-span. In addition, although a technique of installing the wafer in the circuit board is not particularly limited, when lead terminals derived from the first fixed contact are arranged at a plurality of points of an outer peripheral portion of the wafer and the wafer is electrically and mechanically connected to the circuit board by soldering each of the lead terminals to a corresponding connection land of the circuit board, connection reliability may be enhanced by the technique at low cost.

In the multi-directional switch device of the present invention, not only a specific signal is able to be output from the rotation switch mechanism by rotating the operation shaft, but also the signal corresponding to the rotating operation position and the tilting operation direction is able to be output from the slide switch mechanism by rotating the operation shaft to set the rotation holder to a predetermined rotation position and then tilting the operation shaft. Therefore, various switch functions needed for the input operation unit and the like of the power mirror device are able to be realized by the rotation switch mechanism arranged on the one surface side of the circuit board and the slide switch mechanism arranged on the other surface side. In addition, since the multi-directional switch device is able to selectively perform the rotating operation and the tilting operation using the single operation knob, usability is good. In addition, since a pressing operation is unnecessary, depth dimensions (height dimensions) and the number of components are easily suppressed. That is, according to the present invention, a multi-directional switch device which has excellent operability and easily achieves a reduction in cost and size, when this device is used as the input operation unit of a power mirror device, significantly practical effects may be anticipated.

DESCRIPTION OF THE EXEMPLARY EMBODIMENTS

Figure 1:
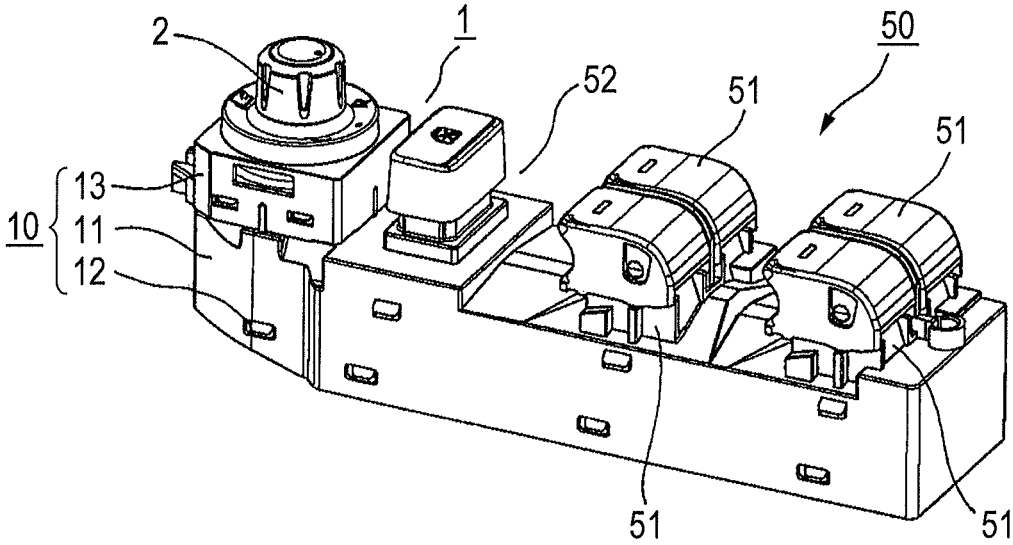
FIG. 1 is a perspective view of the outer appearance of a switch unit including a multi-directional switch device according to an embodiment of the present invention.
Figure 2:
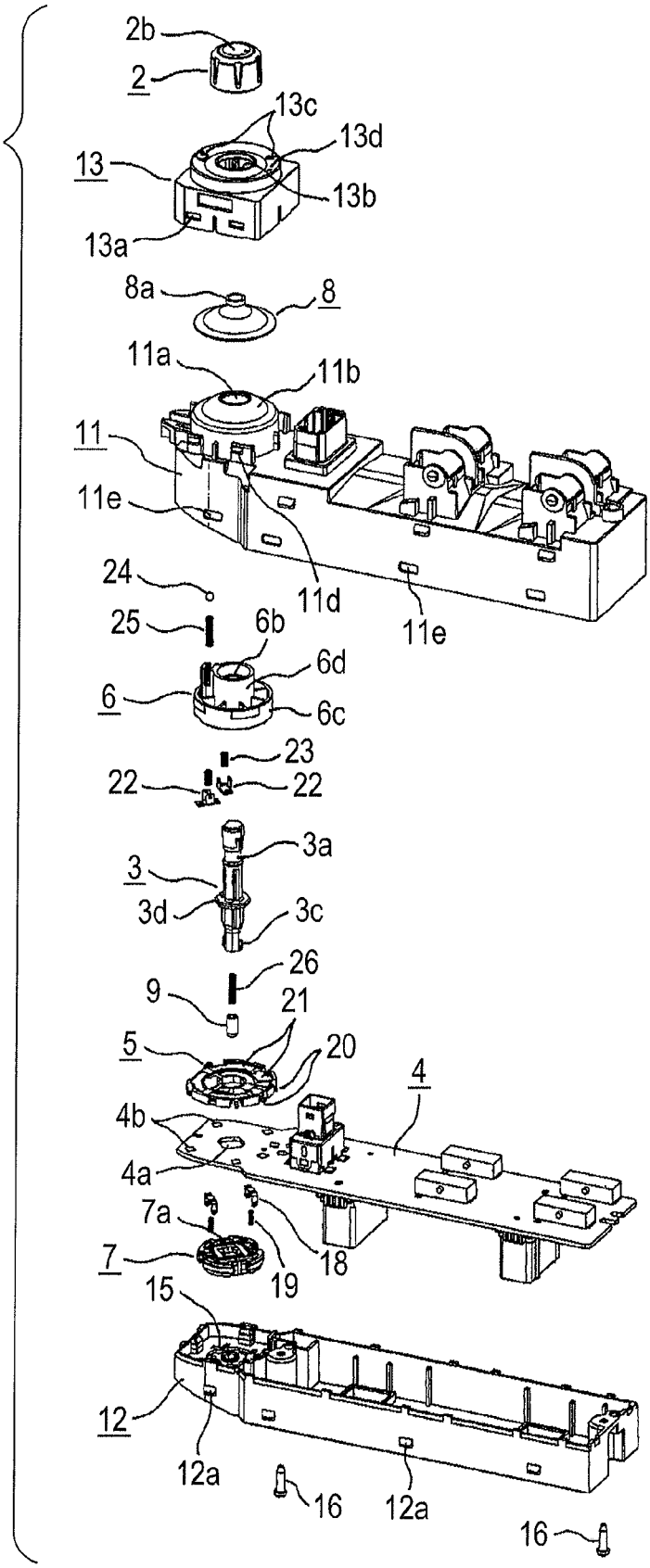
FIG. 2 is an exploded perspective view of the multi-directional switch device.

Hereinafter, embodiments of the present invention will be described with reference to the drawings. A multi-directional switch device 1 according to an embodiment of the present invention is used as an input operation unit of a power mirror device mounted in a vehicle, and the multi-directional switch device 1 is provided in the front end portion of a switch unit 50 illustrated in FIGS. 1, 4, 9 to 11, and the like.

In addition, in the switch unit 50, besides the multi-directional switch device 1, four oscillation operation type switch devices 51 and a single push operation type switch device 52 are arranged. Each of the oscillation operation type switch devices 51 is a switch device for opening and closing a power window, and the push operation type switch device 52 is a switch device for locking and releasing the opening and closing of the power window. Such switch devices 51 and 52 are not directly related to the present invention, and thus description thereof will be omitted.

As illustrated in FIGS. 1 to 8, the multi-directional switch device 1 according to this embodiment is mainly constituted by an operation shaft 3 to which an operation knob 2 is attached to the upper end portion and which is able to perform a rotating operation or a tilting operation, a housing 10 which supports the operation shaft 3 so as to be rotated or oscillated, and a circuit board 4, a wafer 5, a rotation holder 6, a rotation slider 7, and the like assembled into the housing 10.

Figure 3:
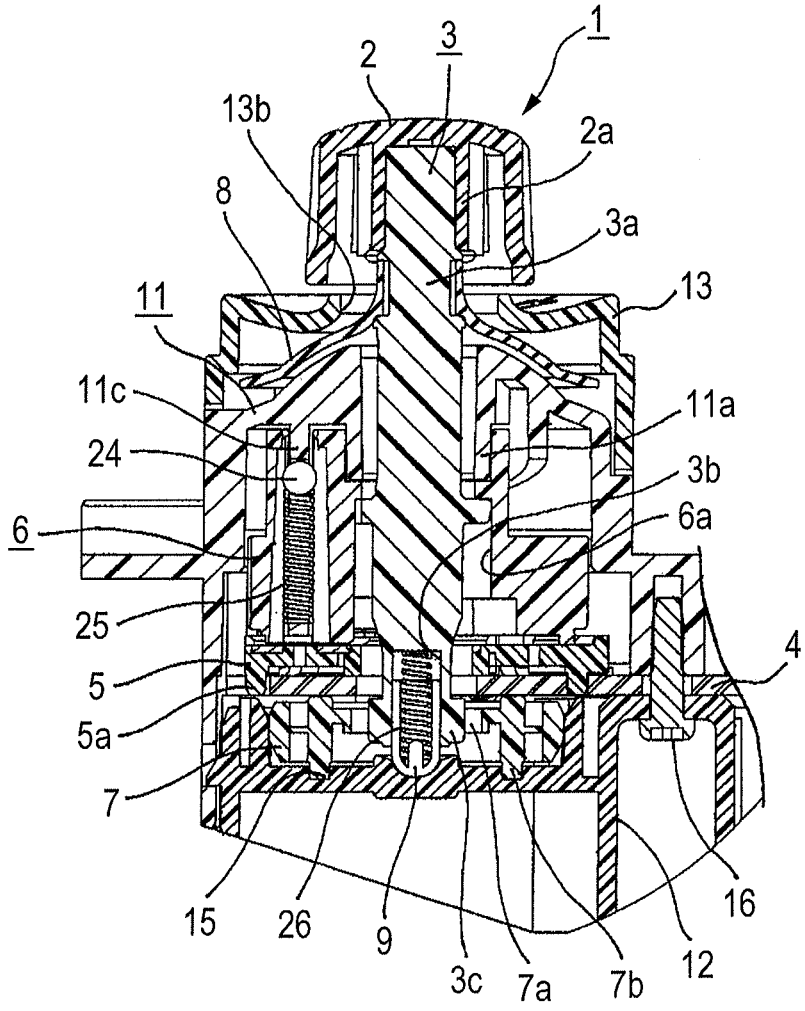
FIG. 3 is a longitudinal sectional view of the multi-directional switch device.
Figure 4:
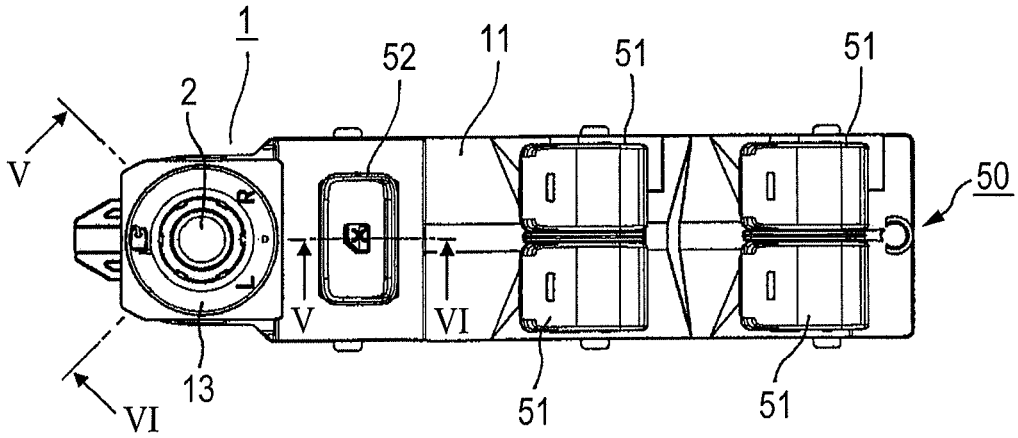
FIG. 4 is a plan view of the switch unit illustrated in FIG. 1.
Figure 5:
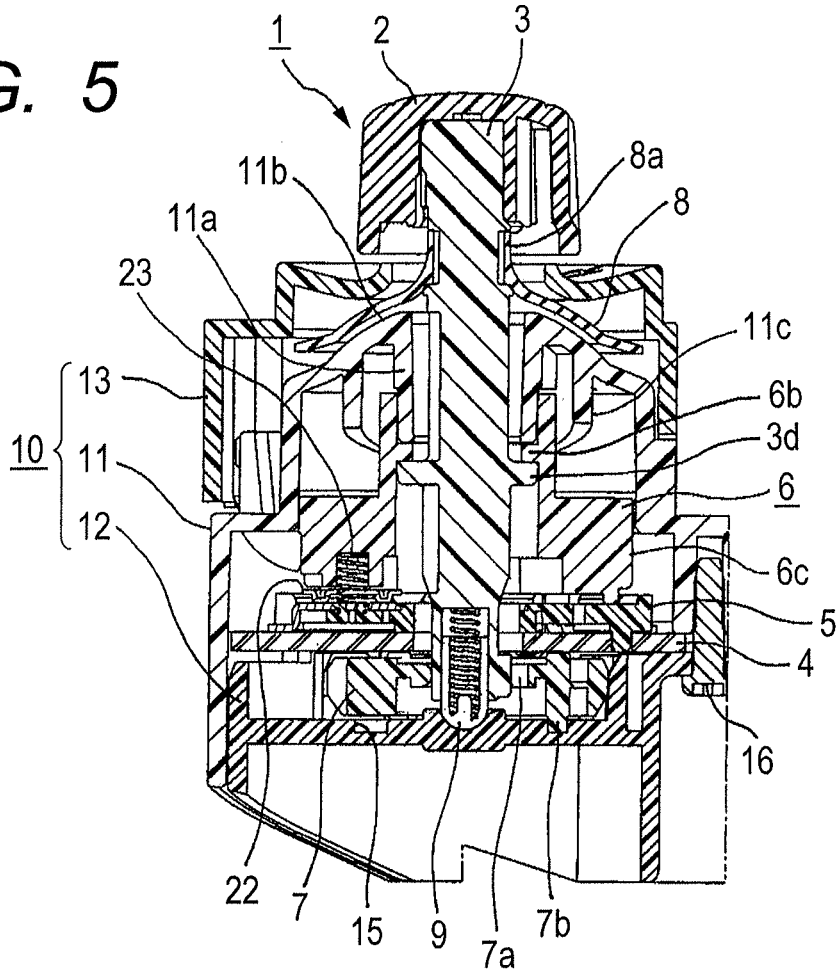
FIG. 5 is a cross-sectional view of the main parts taken along the line V-V of FIG. 4.

The housing 10 is formed by integrating a case 11, a lower cover 12 that covers the lower opening of the case 11, and an upper cover 13 mounted in the front end portion of the case 11, and all the three components 11, 12, and 13 are resin molded products. A swollen shape portion 11*b* protrudes upward from the front end portion of the case 11, and a restriction cylinder portion 11*a* is suspended from the center of the swollen shape portion 11*b*. The swollen shape portion 11*b* is covered by a waterproof rubber 8, and the swollen shape portion 11*b* and the waterproof rubber 8 are covered by the upper cover 13. As illustrated in FIGS. 3 and 5, the operation shaft 3 is loosely fitted into the restriction cylinder portion 11*a*, and a cylindrical portion 8*a* of the waterproof rubber 8 is adhered to a columnar portion 3*a* of the operation shaft 3. In addition, an annular wall portion 11*c* is suspended from the swollen shape portion 11*b* so as to surround the restriction cylinder portion 11*a*, and the bottom surface of the annular wall portion 11*c* is a cam surface that extends along the rotational direction of the rotation holder 6. The cam surface has trough portions at four points in the circumferential direction, and as described later, a steel ball 24 is engaged with and disengaged from the trough portions while sliding on the cam surface as the rotation holder 6 is rotated.

Figure 12:
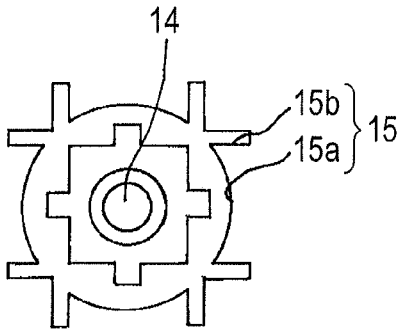
FIG. 12 is a plan view of the main parts illustrating a guide groove and a concave receiving surface provided in the inner bottom portion of a housing of the multi-directional switch device.

Locking holes 13*a* are bored through both side walls of the upper cover 13 that oppose each other, and by fitting corresponding engagement protrusions 11*d* of the case 11 into the locking holes 13*a*, the upper cover 13 is snapped closed by the case 11. A shaft hole 13*b* is bored through the center of the top surface of the upper cover 13, and a pictograph 13*c* and a start point mark 13*d* are drawn in an annular region that surrounds the shaft hole 13*b* (see FIG. 7). In addition, engagement protrusions 12*a* are provided on both side walls of the lower cover 12 that oppose each other, and by fitting the engagement protrusions 12*a* into corresponding locking holes 11*e* of the case 11, the lower cover 12 is snapped closed by the case 11. As illustrated in FIG. 12, in the inner bottom surface of the front end portion of the lower cover 12, a concave receiving surface 14 and a guide groove 15 are formed. The guide groove 15 is a groove formed by causing an annular groove portion 15*a* that extends in an annular form in the periphery of the concave receiving surface 14 and a linear groove portion 15*b* that extends outward from the position of each of four points separated at equal intervals of the annular groove portion 15*a*, for example, at 90 degrees, to be continuous. The inner bottom surface of the lower cover 12 is a mounting surface that supports the operation shaft 3 and the rotation slider 7, the concave receiving surface 14 supports the operation shaft 3 via an actuator 9 described later, and a sliding pin 7*b* of the rotation slider 7 described later is inserted into the guide groove 15 so as to be slidable.

Figure 7:
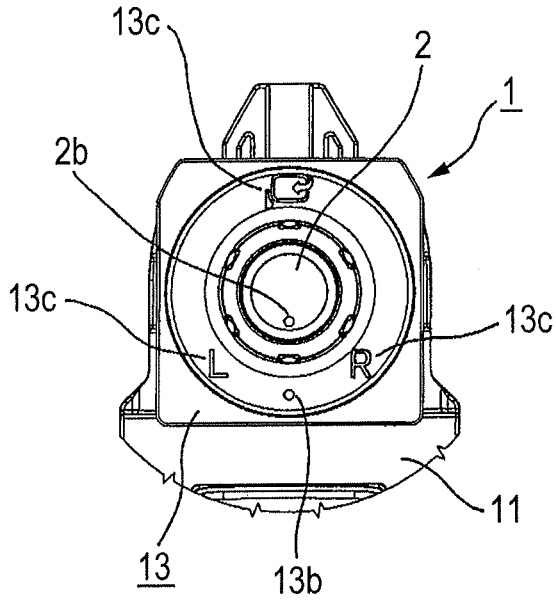
FIG. 7 is a plan view of the multi-directional switch device.
Figure 8:
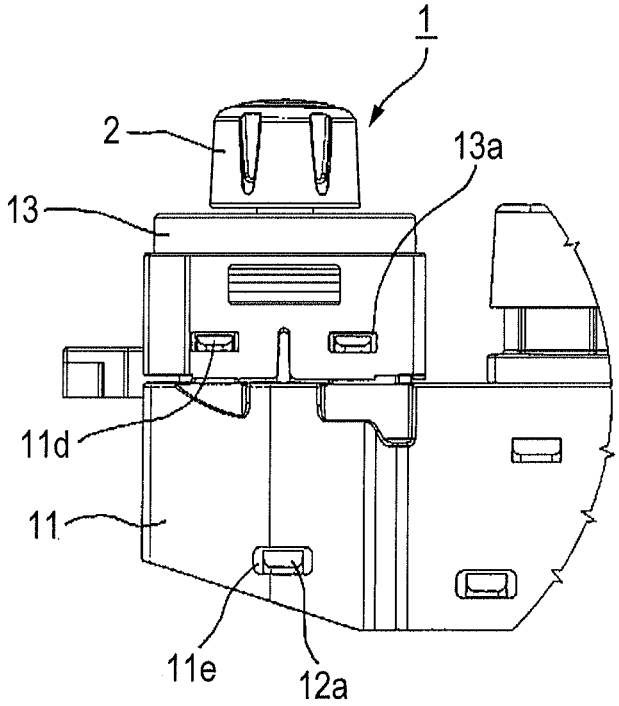
FIG. 8 is a side view of the multi-directional switch device.
Figure 9:
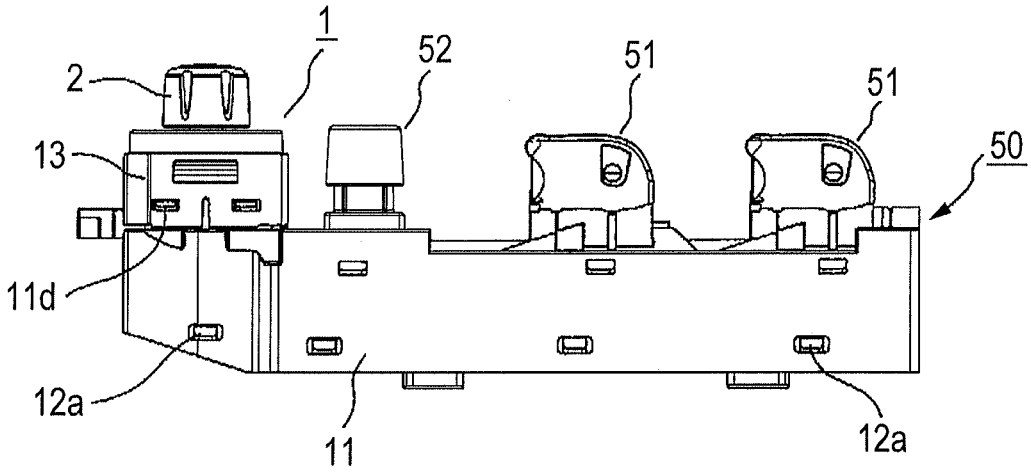
FIG. 9 is a side view of the switch unit illustrated in FIG. 1.
Figure 10:
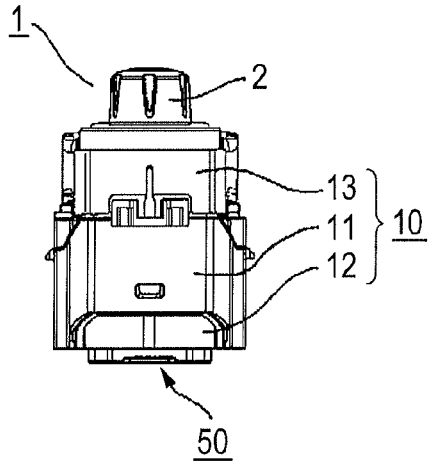
FIG. 10 is a front view of the switch unit illustrated in FIG. 1.
Figure 11:
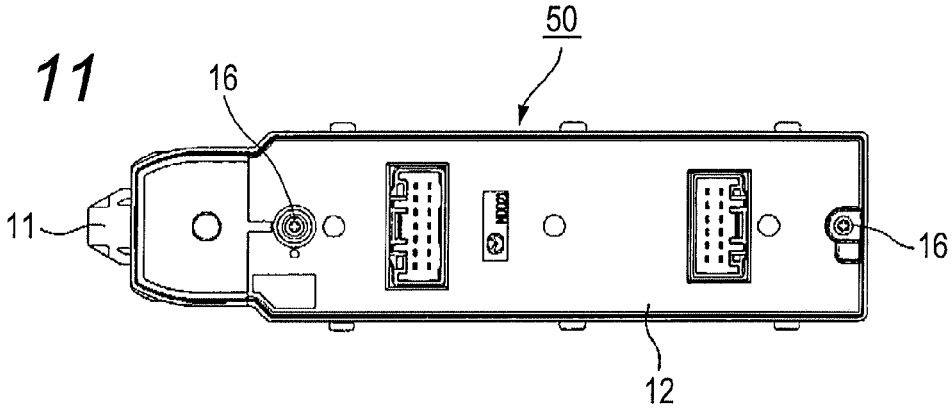
FIG. 11 is a bottom view of the switch unit illustrated in FIG. 1.

The operation knob 2 is a resin molded product having a cap shape, and the upper end portion of the operation shaft 3 protruding upward from the upper cover is capped with the operation knob 2. As illustrated in FIGS. 3 and 5, an inner peripheral wall portion 2*a* is provided in the operation knob 2 so as to be fitted on the upper end portion of the operation shaft 3, and thus the operation shaft 3 is invisible from the outside by being capped with the operation knob 2. In addition, the shaft hole 13*b* of the upper cover 13 and the cylindrical portion 8*a* of the waterproof rubber 8 are covered with the operation knob 2 and thus are substantially invisible from the outside. As illustrated in FIG. 7, a position display mark 2*b* for specifying the rotation position is drawn on the top surface of the operation knob 2.

The operation shaft 3 is a columnar resin molded product, and the vicinity of the upper end thereof is a columnar portion 3*a* having a slightly smaller diameter. In addition, by inserting the columnar portion 3*a* into the cylindrical portion 8*a* in the shaft hole 13*b* of the upper cover 13, the waterproof rubber 8 is mounted to the operation shaft 3. As illustrated in FIG. 3, an empty space 3*b* is provided in the lower end portion of the operation shaft 3, and the actuator 9 and a coil spring 26 are assembled in the empty space 3*b*. The coil spring 26 is elastically biased in such a direction that the actuator 9 protrudes outward in the axial direction of the operation shaft 3, and by the biasing force, the lower end portion of the actuator 9 comes into elastic contact with the concave receiving surface 14. In addition, when the operation shaft 3 is tilted, the actuator 9 is raised while sliding on the concave receiving surface 14 (see FIG. 14), and when the operation shaft 3 is tilted at a predetermined angle, the actuator 9 climbs over a minute stepped portion (not shown) previously formed in the concave receiving surface 14 and thus a clicking sensation occurs. In addition, a pair of protruding bars 3*c* are provided on the outer peripheral surface of the lower end portion of the operation shaft 3, and the protruding bars 3*c* are inserted into the cut-out portions of engagement holes 7*a* of the rotation slider 7. Accordingly, the operation shaft 3 and the rotation slider 7 rotate integrally with each other. Moreover, a holder driving portion 3*d* is provided on the outer peripheral surface of the operation shaft 3, and the holder driving portion 3*d* protrudes in an octagonal shape on the outside in the diameter direction at a substantially center position between the columnar portion 3*a* and the protruding bars 3*c*.

The circuit board 4 is mounted on the lower cover 12 and is covered by the case 11, and the circuit board 4 is fastened and fixed to the case 11 and the lower cover 12 using a plurality of fixing screws 16. The circuit board 4 has substantially the same longitudinal shape as the lower cover 12 on the whole, the front end portion thereof is used for the multi-directional switch device 1, and the remaining part of the circuit board 4 is used for the oscillation operation type switch devices 51 and the push operation type switch device 52. A through-hole 4*a* through which the operation shaft 3 penetrates is bored through the front end portion of the circuit board 4, and as illustrated in FIGS. 15 and 16, fixed contact groups 17 having substantially the same shape are arranged in the lower surface of the circuit board 4 at four points at equal intervals to surround the through-hole 4*a*. The four fixed contact groups 17 are constituted by a plurality of fixed contacts that extend in the longitudinal direction of the circuit board 4 and a plurality of fixed contacts that extend in the width direction of the circuit board 4. As described later, a pair of second movable contacts 18 held in the rotation slider 7 are able to come into contact with and be separated from the fixed contact groups 17. Here, the two fixed contact groups 17 that are parallel in the width direction of the circuit board 4 with the through-hole 4*a* interposed therebetween form a pair, and the remaining two fixed contact groups 17 that are parallel in the longitudinal direction of the circuit board 4 with the through-hole 4*a* interposed therebetween also form a pair. In addition, when the rotation slider 7 slides along the circuit board 4 during the tilting operation of the operation shaft 3, the contact positions of the second movable contacts 18 with respect to the fixed contact groups 17 that form the pair as the rotation slider 7 slides are changed, thereby outputting a signal corresponding to the slide direction of the rotation slider 7. In addition, in FIGS. 15 and 16, the circuit board 4 is viewed from the lower surface side, and thus the left and the right are reversed in a case of being viewed from above.

Figure 13A:
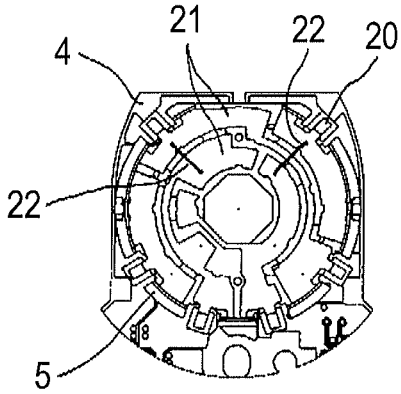
FIGS. 13A and 13B are explanatory views illustrating contact positions between fixed contacts and movable contacts of a rotation switch mechanism included in the multi-directional switch device.
Figure 13B:
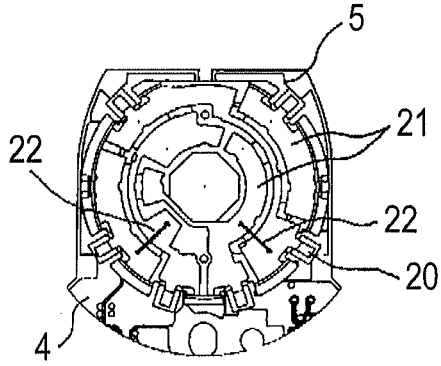

The wafer 5 is a discoid body molded by an insert molding technique, and as the resin material thereof, a synthetic resin, which has higher heat resistance than the circuit board 4, is used. Positioning pins 5*a* (see FIG. 3) protrude from two points of the lower surface of the wafer 5, and as illustrated in FIG. 13, a plurality of fixed contact patterns 21 are provided on the upper surface of the wafer 5. The fixed contact patterns 21 extend along the rotational direction of the rotation holder 6, and lead terminals 20 derived from each of the fixed contact patterns 21 are arranged on the wafer 5. The wafer 5 is placed and fixed to a region that surrounds the through-hole 4*a* on the upper surface of the circuit board 4, and the center portion of the wafer 5 is provided with an opening opposing the through-hole 4*a*. Here, in a state where the positioning pin 5*a* is inserted into the positioning hole 4*a* of the circuit board 4 so as to be positioned, each of lead terminals 20 is soldered to a corresponding connection land 4*b* (see FIG. 2) of the circuit board 4.

The rotation holder 6 is a resin molded product having a shape in which a cylindrical portion 6*d* protrudes from the inside of the large diameter portion 6*c*, an annular restriction collar portion 6*b* is formed on the inner wall surface of the cylindrical portion 6*d*, and a cavity 6*a* having an octagonal column shape is formed below the restriction collar portion 6*b*. The rotation holder 6 is rotatably interposed between the restriction cylinder portion 11*a* of the case 11 and the wafer 5, and the operation shaft 3 is inserted through the cylindrical portion 6*d* of the rotation holder 6. Here, the holder driving portion 3*d* of the operation shaft 3 is inserted into the cavity 6*a* and abuts on the restriction collar portion 6*b*. Therefore, in a state where the actuator 9 always comes into elastic contact with the concave receiving surface 14 of the lower cover 12, the height position of the operation shaft 3 in the housing 10 is restricted. In addition, the outer shapes of the holder driving portion 3*d* and the cavity 6*a* are substantially the same in plan view and thus the operation shaft 3 and the rotation holder 6 rotate integrally. However, the operation shaft 3 is engaged with the inner wall portion of the cylindrical portion 6*d* in a loosely-fitted state in which its oscillation is allowed.

Figure 6:
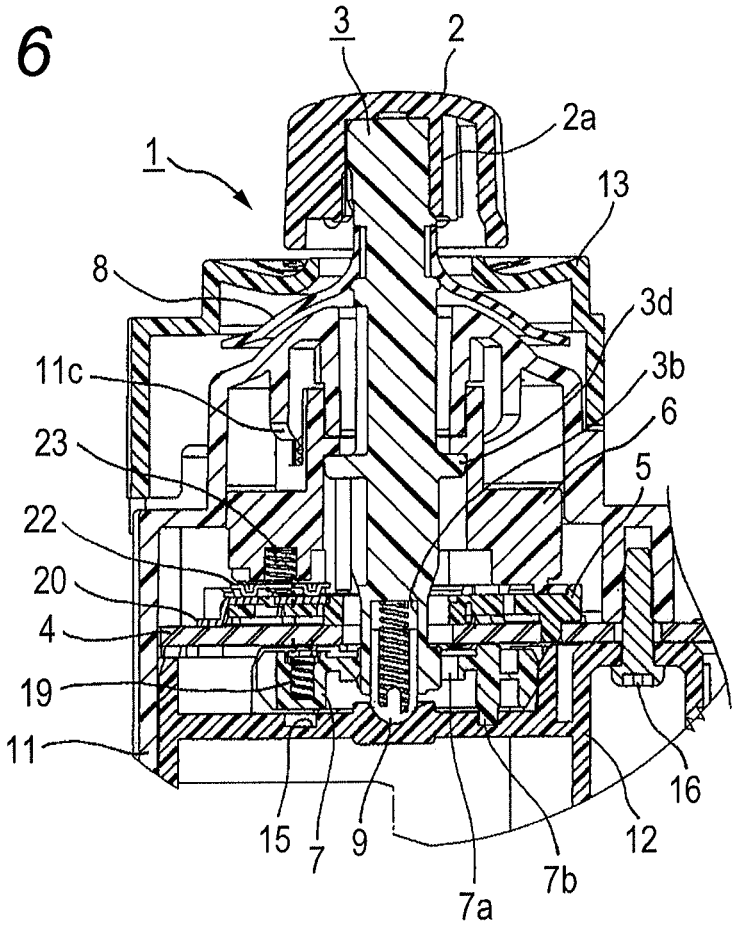
FIG. 6 is a cross-sectional view of the main parts taken along the line VI-VI of FIG. 4.

A first movable contact 22 and a coil spring 23 are assembled to each of two points separated in the peripheral direction by 90 degrees on the bottom surface of the large diameter portion 6*c* of the rotation holder 6. As illustrated in FIGS. 5 and 6, each of the first movable contacts 22 is biased against the coil spring 23 from above and comes in elastic contact with the upper surface of the wafer 5, and the first movable contacts 22 are able to come into contact with or be separated from the fixed contact patterns 21 provided in the wafer 5.

The steel ball 24 and a coil spring 25 are assembled on one side portion of the cylindrical portion 6*d* of the rotation holder 6, and the steel ball 24 is biased against the coil spring 25 and comes into elastic contact with the bottom surface (cam surface) of the annular wall portion 11*c* of the case 11 (see FIG. 3). The cam surface has the four trough portions as described above, and the steel ball 24 slides on the cam surface as the rotation holder 6 that is linked with the operation shaft 3 is rotated. In addition, when the steel ball 24 enters an arbitrary trough portion, the operation shaft 3 is held at the rotational position, and when the steel ball 24 climbs over the crest portion from the single trough portion and then enters the next trough portion, a clicking sensation occurs. In addition, regarding the positions of the four trough portions formed on the bottom surface of the annular wall portion 11*c*, as illustrated in FIG. 7, when the position display mark 2*b* of the operation knob 2 indicates the start point mark 13*d* of the upper cover 13, the position that opposes the steel ball 24 (reference position) opposes each of two positions (tiltable positions) separated from the reference position by about ±45 degrees and positions (storage positions) separated by about 180 degrees with a point symmetry from the reference position with respect to the rotating shaft of the operation knob 2. In addition, when the position display mark 2*b* of the operation knob 2 indicates "R" or "L" of the pictograph 13*c*, the steel ball 24 opposes any one of the tiltable positions.

Figure 14:
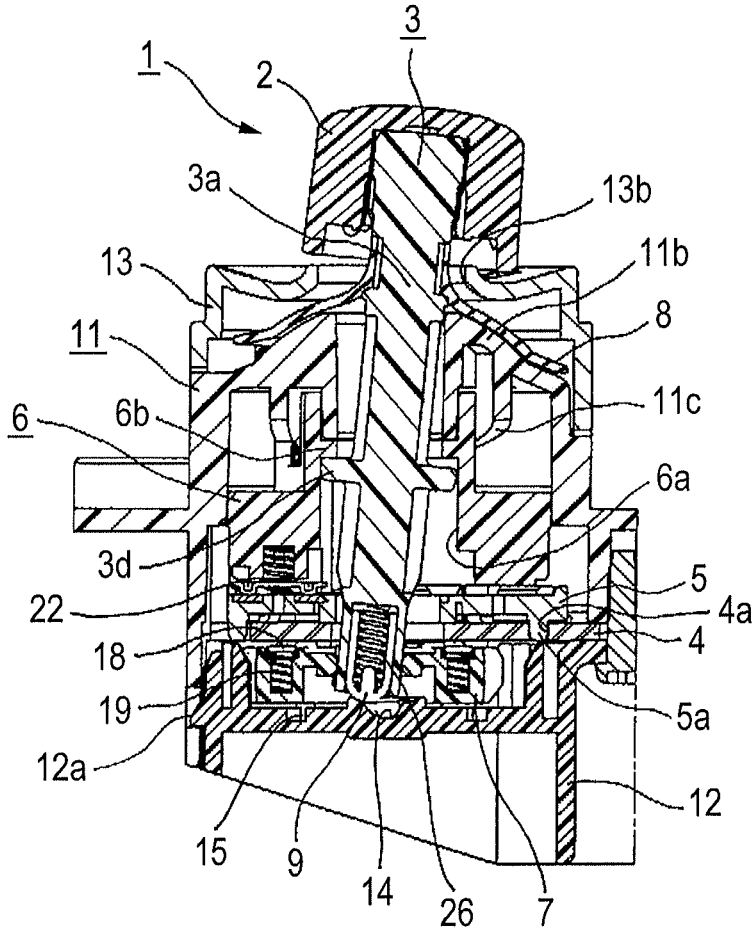
FIG. 14 is an operation explanatory view illustrating a state where an operation shaft in the multi-directional switch device is tilted.

The operation shaft 3 is inserted through the rotation holder 6 to rotate integrally. However, even though the operation shaft 3 is tilted, the rotation holder 6 is not moved. That is, the operation shaft 3 is inserted to penetrate through the cylindrical portion 6*d* from the large diameter portion 6*c* side of the rotation holder 6 during assembly, and the holder driving portion 3*d* having the octagonal shape is inserted into the cavity 6*a* having the octagonal column shape so as to be engaged with each other. Therefore, when the operation shaft 3 is rotated, the rotation holder 6 rotates integrally. However, since the holder driving portion 3*d* is engaged with the inner wall surface of the cavity 6*a* in a loosely-fitted state in which oscillation of the operation shaft 3 is allowed, the rotation holder 6 interposed in the height direction is not moved by being linked even though the operation shaft 3 is tilted. In addition, since the holder driving portion 3*d* of the operation shaft 3 abuts on the restriction collar portion 6*b* of the rotation holder 6 so as to cause the position thereof to be restricted, as illustrated in FIG. 14, during the tilting operation of the operation shaft 3, a point at which the restriction collar portion 6*b* and the holder driving portion 3*d* abut on each other on the opposite side of the tilt direction becomes an oscillation spot.

The rotation holder 6, the first movable contacts 22, and the fixed contact patterns 21 constitute a rotation switch mechanism of the multi-directional switch device 1. The rotation switch mechanism is arranged on the upper surface side of the circuit board 4 in the housing 10, and during the non-operation of the multi-directional switch device 1, the steel ball 24 opposes the reference position to hold the rotation holder 6 at a rotation neutral position. In addition, when the operation shaft 3 is operated to rotate by half the circumference and thus the rotation holder 6 is rotated by 180 degrees from the rotation neutral position, the steel ball 24 opposes the storage position to hold the rotation holder 6 at a first rotation position, and a first signal is output from the rotation switch mechanism.

The rotation slider 7 is a discoid resin molded product, and as described above, the lower end portion of the operation shaft 3 is inserted through the engagement hole 7*a* provided at the center of the rotation slider 7. In addition, the sliding pins 7*b* protrude from the four points of the bottom surface of the rotation slider 7, and the sliding pins 7*b* are inserted to be slidable in the guide groove 15 of the lower cover 12 so as to cause the positions thereof to be restricted by the annular groove portion 15*a* and the linear groove portion 15*b*. The rotation slider 7 rotates integrally with the rotating operation of the operation shaft 3, and when the operation shaft 3 is tilted, the rotation slider 7 slides in a linear form in specific directions (the longitudinal direction and the width direction of the circuit board 4) along the circuit board 4. In addition, during the rotation of the rotation slider 7, the sliding pins 7*b* move along the annular groove portion 15*a*, and during the sliding of the rotation slider 7, the sliding pins 7*b* move along the linear groove portion 15*b*.

A second movable contact 18 and a coil spring 19 are assembled to each of two points separated in the peripheral direction by 180 degrees on the surface of the rotation slider 7. As illustrated in FIG. 14, each of the second movable contacts 18 is biased against the coil spring 19 from below and comes into elastic contact with the lower surface of the circuit board 4, and thus the second movable contacts 18 are able to come into contact with and be separated from the fixed contact groups 17 provided on the lower surface of the circuit board 4.

The rotation slider 7, the second movable contacts 18, and the fixed contact groups 17 constitute a slide switch mechanism of the multi-directional switch device 1. The slide switch mechanism is arranged on the lower surface side of the circuit board 4 in the housing 10. When the operation shaft 3 is rotated by about ±45 degrees from the rotation neutral position, the steel ball 24 opposes the tiltable position to hold the rotation holder 6 at a second rotation position or a third rotation position, and when the operation shaft 3 is tilted in this state, a second signal or a third signal is output from the slide switch mechanism.

Next, the operations of the multi-directional switch device 1 configured as described above will be described.

During the non-operation of the multi-directional switch device 1, as illustrated in FIG. 7, the position display mark 2*b* of the operation knob 2 indicates the start point mark 13*d*, and the rotation holder 6 is held at the rotation neutral position. Here, the first movable contact 22 comes into contact with the fixed contact pattern 21 at the position illustrated in FIG. 13A, and the contacts of the rotation switch mechanism is in an OFF state. This state corresponds to a state where the left and right side mirrors are folded out.

When a user rotates the operation knob 2 by half the circumference, the rotation holder 6 is rotated by about 180 degrees from the rotation neutral position and is held at the first rotation position. Therefore, the first movable contact 22 comes into contact with the fixed contact pattern 21 at the position illustrated in FIG. 13B, and the first signal is output from the rotation switch mechanism. The first signal is a command signal for folding in the left and right side mirrors, and thus both the side mirrors are driven by a motor to be stored. In addition, when the user returns the operation knob 2 to its original rotation position, the motor is reversed to fold out both the side mirrors. In addition, while the rotation holder 6 is held at the rotation neutral position or the first rotation position, the position of sliding pins 7*b* of the rotation slider 7 is restricted by the annular groove portion 15*a* and thus an operation of sliding along the linear groove portion 15*b* is not able to be performed. Therefore, the operation shaft 3 is in a state of being able to perform only the rotating operation and not able to perform the tilting operation.

When the left and right side mirrors are folded out, that is, when the rotation holder 6 is held at the rotation neutral position, if the user rotates the operation knob 2 counterclockwise as in FIG. 7 by about 45 degrees so as to cause the position display mark 2*b* to indicate "R" of the pictograph 13*c*, the rotation holder 6 is held at the second rotation position, and the sliding pins 7*b* of the rotation slider 7 are positioned in the vicinity of the center of the position where the linear groove portion 15*b* intersects at 90 degrees. Accordingly, the operation shaft 3 is tiltable, and as the user tilts the operation shaft 3 toward any of the front, the rear, the left, and right via the operation knob 2, the rotation slider 7 is slid in a direction corresponding to the tilt direction of the operation shaft 3 to cause the slide switch mechanism to output the second signal.

Figure 15A:
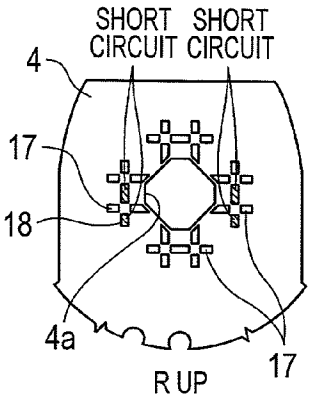
FIGS. 15A to 15D are explanatory views illustrating ON states of contact points of a slide switch mechanism included in the multi-directional switch device according to tilting operation directions during adjustment of the visual angle of a right side mirror.
Figure 15B:
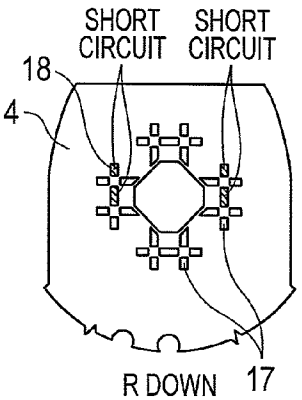
Figure 15C:
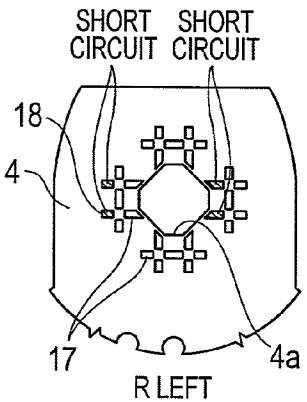
Figure 15D:
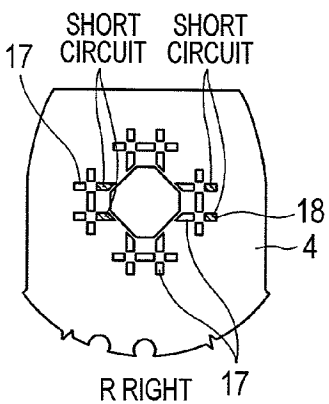

That is, when the operation shaft 3 is tilted forward (upward in FIG. 7) in the state where the rotation holder 6 is held at the second rotation position, as illustrated in FIG. 15A, the left and right fixed contact groups 17 which form a pair output a signal as the lower fixed contacts are short-circuited by the second movable contacts 18. Since this signal is a command signal for tilting the mirror surface of the right side mirror upward, the visual angle of the right side mirror is adjusted to be upward. When the operation shaft 3 is tilted rearward (downward in FIG. 7) in the state where the rotation holder 6 is set to the second rotation position, as illustrated in FIG. 15B, the left and right fixed contact groups 17 which form a pair output a signal as the lower fixed contacts are short-circuited by the second movable contacts 18, and thus the visual angle of the right side mirror is adjusted to be downward. Similarly, when the operation shaft 3 is tilted to the left as in FIG. 7, as illustrated in FIG. 15C, the left and right fixed contact groups 17 which form a pair output a signal as the fixed contacts illustrated on the left (on the right as viewed from above) are short-circuited by the second movable contacts 18, and thus the visual angle of the right side mirror is adjusted to be leftward. In addition, when the operation shaft 3 is tilted to the right as in FIG. 7, as illustrated in FIG. 15D, the left and right fixed contact groups 17 which form a pair output a signal as the fixed contacts illustrated on the right (on the left as viewed from above) are short-circuited by the second movable contacts 18, and thus the visual angle of the right side mirror is adjusted to be rightward.

On the other hand, when the rotation holder 6 is held at the rotation neutral position, if the user rotates the operation knob 2 clockwise as in FIG. 7 by about 45 degrees so as to cause the position display mark 2*b* to indicate "L" of the pictograph 13*c*, the rotation holder 6 is held at the third rotation position, and the sliding pins 7*b* of the rotation slider 7 are positioned in the vicinity of the center of the position where the linear groove portion 15*b* intersects at 90 degrees. Accordingly, the operation shaft 3 is tiltable, and as the user tilts the operation shaft 3 toward any of the front, the rear, the left, and right via the operation knob 2, the rotation slider 7 is slid in a direction corresponding to the tilt direction of the operation shaft 3 to cause the slide switch mechanism to output the third signal.

Figure 16A:
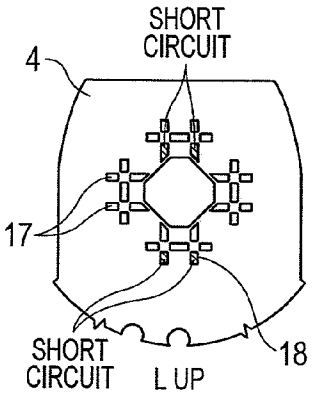
FIGS. 16A to 16D are explanatory views illustrating ON states of the contact points of the slide switch mechanism according to tilting operation directions during adjustment of the visual angle of a left side mirror.
Figure 16B:
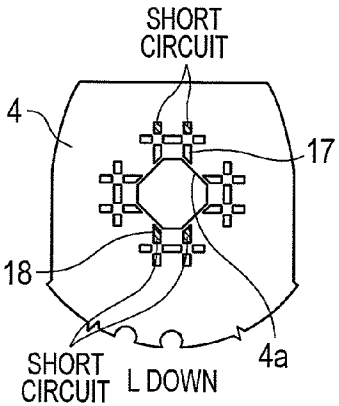
Figure 16C:
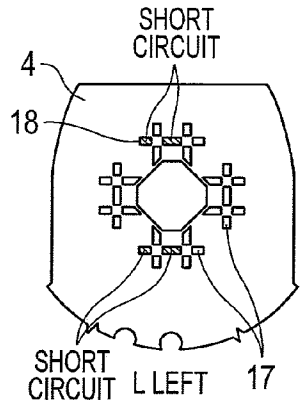
Figure 16D:
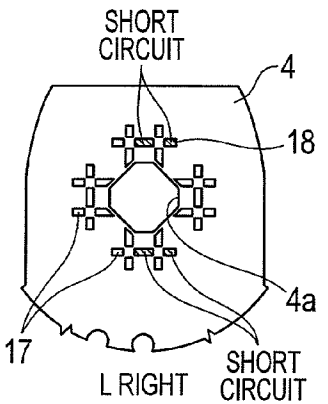

That is, when the operation shaft 3 is tilted forward in the state where the rotation holder 6 is held at the third rotation position, as illustrated in FIG. 16A, the upper and lower fixed contact groups 17 which form a pair output a signal as the lower fixed contacts are short-circuited by the second movable contacts 18. Since this signal is a command signal for tilting the mirror surface of the left side mirror upward, the visual angle of the left side mirror is adjusted to be upward. In addition, when the operation shaft 3 is tilted rearward, to the left, and to the right in the state where the rotation holder 6 is held at the third rotation position, the contact positions of the second movable contacts 18 with respect to the upper and lower fixed contact groups 17 which form a pair are respectively changed as illustrated in FIGS. 16B, 16C, and 16D. Therefore, the visual angle of the left side mirror is adjusted to be downward, rightward, and leftward, respectively.

In addition, while the operation shaft 3 is tilted, the position of sliding pins 7*b* of the rotation slider 7 is restricted by the linear groove portion 15*b* and thus an operation of rotating along the annular groove portion 15*a* is not able to be performed. Therefore, the operation shaft 3 is in a state of being able to perform only the tilting operation and not able to perform the rotating operation.

As described above, in the multi-directional switch device 1 according to this embodiment, the first signal is able to be output from the rotation switch mechanism by rotating the operation shaft 3. In addition, as the operation shaft 3 is rotated to set the rotation holder 6 to the second rotation position or the third rotation position and then the operation shaft 3 is tilted, the second signal or the third signal corresponding to the rotating operation position and the tilting operation direction is able to be output from the slide switch mechanism. Therefore, in the multi-directional switch device 1, various switch functions needed for the input operation unit of the power mirror device are able to be realized by the rotation switch mechanism arranged on the upper surface side of the circuit board 4 and the slide switch mechanism arranged on the lower surface side. In addition, since the multi-directional switch device 1 is able to selectively perform the rotating operation and the tilting operation using the single operation knob 2, usability is good. Moreover, since a pressing operation is unnecessary, depth dimensions (height dimensions) and the number of components are easily suppressed. As a result, a switch device which is operable in multiple directions and thus has excellent operability, and easily achieves a reduction in cost and size and thus has a high practical value is provided.

In the multi-directional switch device 1 according to this embodiment, the first signal is output when the rotation holder 6 is set to the first rotation position separated from the rotation neural position by about 180 degrees, and the second signal or the third signal corresponding to the tilt direction of the operation shaft 3 is output when the operation shaft 3 is tilted in the state where the rotation holder 6 is set to the second rotation position or the third rotation position separated from the rotation neutral position by about ±45 degrees. That is, the rotation neutral position and the first rotation position have a positional relationship of a point symmetry with respect to the rotating shaft of the operation knob 2, and the second rotation position and the third rotation position have a positional relationship of a line symmetry with respect to the straight line connecting the rotation neutral position and the first rotation position. Moreover, clear distinguishment between the first, second, and third rotation positions is considered. Therefore, the multi-directional switch device 1 is easily prevented from an operation error.

However, the angle between the second or third rotation position and the rotation neutral position is not limited to about 45 degrees, and positions distant from the rotation neutral position at angles smaller than 180 degrees may be set to the second and third rotation positions.

In addition, in the multi-directional switch device 1 according to this embodiment, the upper end portion of the operation shaft 3 protrudes outward from an accommodation space on the upper surface side of the circuit board 4 arranged in the housing 10, the operation shaft 3 is tilted using the point where the restriction collar portion 6*b* of the rotation holder 6 and the holder driving portion 3*d* arranged in this accommodation space as the oscillation spot, and the lower end portion of the operation shaft 3 is arranged in an accommodation space on the lower surface side of the circuit board 4. Therefore, in the multi-directional switch device 1, the tilt angle of the operation shaft 3 needed for the tilting operation and the sliding movement amount of the rotation slider 7 are easily set to desired values, and the support structure of the rotation holder 6 and the rotation slider 7 is relatively simple.

In addition, in the multi-directional switch device 1 according to this embodiment, the bottom surface of the annular wall portion 11*c* suspended in the case 11 of the housing 10 is formed as the cam surface that extends along the rotational direction of the rotation holder 6, and the steel ball 24 held in the rotation holder 6 is caused to come into elastic contact with the cam surface. In addition, the cam surface is provided with the four trough portions for positioning the rotation holder 6 at the rotation neutral position and the first to third rotation positions, and the steel ball 24 is engaged with and disengaged from the trough portions as the rotation holder 6 is rotated. That is, as the steel ball 24 is caused to enter the trough portion of the cam surface during the rotating operation, the rotation holder 6 is positioned, and a clicking sensation that occurs during the positioning is able to be perceived by a finger of the user. Therefore, in the multi-directional switch device 1, an operation of setting the rotation holder 6 to a desired rotation position is simply and reliably performed. In addition, contrary to this embodiment, a configuration in which the cam surface is provided on the rotation holder 6 side and engagement members such as the steel ball are provided on the housing 10 side may also be employed.

In the multi-directional switch device 1 according to this embodiment, in the region of the inner bottom portion of the lower cover 12 of the housing 10 which supports the rotation slider 7 to be slidable, the guide groove 15 in which the annular groove portion 15*a* that extends in the annular shape and the linear groove portion 15*b* that extends outward from the positions of the four points separated at equal intervals of the annular groove portion 15*a*, for example, at 90 degrees, are continuous is provided, and the position of the sliding pins 7*b* of the rotation slider 7 is restricted by the guide groove 15. That is, the rotation slider 7 moves along the annular groove portion 15*a* during rotation and moves along the linear groove portion 15*b* during sliding. Therefore, when the sliding pin 7*b* deviates from the linear groove portion 15*b* and the position thereof is restricted by the annular groove portion 15*a*, the tilting operation of the operation shaft 3 is able to be impeded by the rotation slider 7, and when the sliding pin 7*b* deviates from the annular groove portion 15*a* and the position thereof is restricted by the linear groove portion 15*b*, the rotating operation of the operation shaft 3 is able to be impeded by the rotation slider 7. From this point, the multi-directional switch device 1 according to this embodiment is less likely to cause an operation error and has good operability.

In addition, the multi-directional switch device 1 according to this embodiment has a configuration in which the actuator 9 which is elastically biased against by the coil spring 26 is assembled to the lower end portion of the operation shaft 3, the concave receiving surface 14 that supports the operation shaft 3 via the actuator 9 is formed in the inner bottom portion of the lower cover 12 of the housing 10, and when the operation shaft 3 is tilted, the actuator 9 is raised while sliding on the concave receiving surface 14. In this configuration, the operating force in the axial direction that is exerted via the operation shaft 3 during the rotating operation or the tilting operation is able to be reliably received by the concave receiving surface 14 and the actuator 9 is able to smoothly slide. Therefore, the multi-directional switch device 1 easily stabilizes the posture of the operation shaft 3 and smoothly performs the rotating operation or the tilting operation.

In addition, it is also possible to apply the multi-directional switch device 1 to a switch device other than that for the power mirror device. However, the multi-directional switch device is particularly appropriate for the power mirror device as in the embodiment to be installed in the vicinity of a driver's seat of a vehicle. In this case, since relatively high current flows during the generation of a signal for causing the side mirrors to perform the folding-in and folding-out operations, when measures against heat generation are considered, reliability may be enhanced.

Here, in this embodiment, in the region that surrounds the through-hole 4*a* in the upper surface of the circuit board 4, the wafer 5 that has higher heat resistance than the circuit board 4 is placed, and the first movable contacts 22 are caused to come into contact with and be separated from the fixed contact patterns 21 provided in the wafer 5. Accordingly, even though relatively high current flows through the fixed contact patterns 21 during the generation of the first signal and causes heat generation, there is no concern of the wafer 5 and the vicinity thereof being thermally damaged, resulting in an increase in the life-span of the multi-directional switch device 1. In addition, the wafer 5 is electrically and mechanically connected to the circuit board 4 by soldering the lead terminals 20 arranged in the outer peripheral portion to the corresponding connection lands 4*b*, and thus reliability of the connection between the circuit board 4 and the wafer 5 is increased.

It should be understood by those skilled in the art that various modifications, combinations, sub-combinations and alterations may occur depending on design requirements and other factors insofar as they are within the scope of the appended claims of the equivalents thereof.

What is claimed is:

1. A multi-directional switch device comprising:

an operation shaft configured to perform a rotating operation and a tilting operation and having an operation knob at one end portion; and a housing which supports the operation shaft so as to be rotatable and tiltable, wherein, in the housing, a circuit board which has a through-hole through which the operation shaft penetrates, a first fixed contact and a second fixed contact formed integrally with the circuit board, a rotation holder through which the operation shaft is inserted in a loosely-fitted state in which oscillation of the operation shaft is allowed and which rotates integrally with the operation shaft, a rotation slider through which the operation shaft is inserted to rotate integrally and which slides linearly along the circuit board by being driven by the tilted operation shaft, a first movable contact which is held in the rotation holder and is configured to come into contact with and be separated from the first fixed contact, and a second movable contact which is held in the rotation slider and is configured to come into contact with and be separated from the second fixed contact are provided, wherein, a rotation switch mechanism which includes the rotation holder, the first movable contact, and the first fixed contact is arranged on one surface side of the circuit board, and a slide switch mechanism which includes the rotation slider, the second movable contact, and the second fixed contact is arranged on the other surface side of the circuit board, wherein, the rotation switch mechanism is configured to output a signal corresponding to at least one rotation position of the rotation holder, and when the rotation holder is set to a predetermined rotation position, the slide switch mechanism is configured to output a signal corresponding to a tilt direction of the operation shaft, wherein, the rotation switch mechanism outputs a first signal when the rotation holder is set to a first rotation position that is farthest from a rotation neutral position, wherein, the slide switch mechanism outputs a second signal corresponding to the tilt direction of the operation shaft as the operation shaft is tilted when the rotation holder is set to a second rotation position that is separated from the rotation neutral position in one direction part way to the first rotation position, wherein, the slide switch mechanism outputs a third signal corresponding to the tilt direction of the operation shaft as the operation shaft is tilted when the rotation holder is set to a third rotation position that is separated from the rotation neutral position in the other direction part way to the first rotation position;

wherein a guide groove which is formed by causing an annular groove portion that extends in an annular form and a linear groove portion that extends outward at predetermined intervals to be continuous is provided on an inner wall surface of the housing, wherein, a plurality of sliding pins protrude from the rotation slider so as to cause positions of the sliding pins to be restricted by the guide groove, and wherein, the sliding pins move along the annular groove portion during rotation of the rotation slider, and the sliding pins move along the linear groove portion during sliding of the rotation slider.

2. The multi-directional switch device according to claim 1, wherein the rotation holder is arranged in an accommodation space on the one surface side of the circuit board in the housing, the operation shaft is tilted using a point that abuts on the rotation holder as an oscillation spot, and the other end portion of the operation shaft is arranged in an accommodation space on the other surface side of the circuit board in the housing.

3. The multi-directional switch device according to claim 1, wherein one of the rotation holder and the housing is provided with a cam surface which extends along a rotational direction of the rotation holder and has trough portions at a plurality of points, and the other thereof holds an engagement member which comes into elastic contact with the cam surface and is configured to be engaged with and disengaged from the trough portions, and the cam surface has the trough portions of which the number is at least four so as to position the rotation holder at the rotation neutral position and the first to third rotation positions, respectively.

4. The multi-directional switch device according to claim 1, wherein an actuator which is biased outward in an axial direction by a spring member is held by the other end portion of the operation shaft, a concave receiving surface, which supports the operation shaft via the actuator, is formed in an inner bottom portion of the housing, and the actuator, which comes into elastic contact with the concave receiving surface, slides on the concave receiving surface as the operation shaft is tilted.

5. The multi-directional switch device according to claim 1, wherein the first signal is a signal for folding in and folding out side mirrors that are attached to the left and right of a vehicle body, the second signal is a signal for adjusting a visual angle by tilting a mirror surface of the side mirror on either the left or right, and the third signal is a signal for adjusting a visual angle by tilting a mirror surface of the side mirror on the other of the left and right.

6. The multi-directional switch device according to claim 5, wherein a wafer which has higher heat resistance than the circuit board is placed in a region of one surface of the circuit board that surrounds the through-hole, and the first fixed contact is provided in the wafer.

7. The multi-directional switch device according to claim 6, lead terminals derived from the first fixed contact are arranged at a plurality of points of an outer peripheral portion of the wafer, and the wafer is electrically and mechanically connected to the circuit board by soldering each of the lead terminals to a corresponding connection land of the circuit board.

* * * * *